US005509543A

United States Patent [19]

Weaver et al.

[11] Patent Number: 5,509,543

[45] Date of Patent: Apr. 23, 1996

[54] CEILING FIXTURE DISPLAY APPARATUS

[75] Inventors: Carlton D. Weaver, Goodells; Richard W. Eastman, Marysville, both of Mich.

[73] Assignee: Eugene Welding Company, Marysville, Mich.

[21] Appl. No.: 227,110

[22] Filed: Apr. 13, 1994

[51] Int. Cl.[6] ..... A47F 7/00

[52] U.S. Cl. ..... 211/189; 211/26

[58] Field of Search ..... 211/189, 191, 211/113, 190, 26

[56] References Cited

U.S. PATENT DOCUMENTS

| | | | |
|---|---|---|---|
| 2,846,221 | 8/1958 | Skinner . | |
| 3,556,310 | 1/1971 | Loukotsky | 211/189 |
| 4,106,248 | 8/1978 | Zapara | 211/189 X |
| 4,656,792 | 4/1987 | Clark . | |
| 4,981,225 | 1/1991 | Cole | 211/189 X |
| 5,114,016 | 5/1992 | Todd . | |

FOREIGN PATENT DOCUMENTS

| | | | |
|---|---|---|---|
| 1383293 | 11/1964 | France | 211/191 |

*Primary Examiner*—Alvin C. Chin-Shue
*Attorney, Agent, or Firm*—Harness, Dickey & Pierce

[57] ABSTRACT

The subject invention is a device for use as a modular display system for ceiling fixtures and, in particular, electrical fixtures and the like such as lighting fixtures and ceiling fans. The invention includes adjacent horizontal trusses which are adjustably supported in a vertical direction upon upright frames that are erected to span specified aisle dimensions. The horizontal trusses provide a portable overhead ceiling for mounting electrical fixtures and the like which are to be displayed.

15 Claims, 2 Drawing Sheets

CEILING FIXTURE DISPLAY APPARATUS

BACKGROUND OF THE INVENTION

1. Field of the Invention

The present invention relates generally to palette racking display structures and, more particularly, to a store display structure for electrical fixtures and the like.

2. Discussion

In recent times, consumers have increasingly demanded a maximization of return for any and all types of expenditures. This demand has resulted in the proliferation of numerous warehouse-type retail stores in which retailers buy goods in nearly wholesale quantities, resulting in vast cost savings. Retailers then pass on their volume savings to consumers by offering the goods at significantly reduced prices, thereby minimizing costs to consumers. In order to provide goods in such volumes, retailers require significantly more floor space in order to stock the large product volumes purchased. Such retail houses are often referred to as consumer warehouses.

Consumer warehouses are spacious buildings significantly larger than many department stores. The large product volumes stocked at the consumer warehouse require significant space to meet the storage needs of the multitude of products stocked by the consumer warehouse. Furthermore, in addition to large product volumes, consumer warehouses also reward their patrons with an almost endless product selection. However, although a seemingly endless product selection delights the consumer, it further necessitates that yet additional space be allocated not only for large products, but also for large product volumes of a significant number of products.

The large product selection and stock requirements present significant layout considerations to store designers. Displays and product shelving ideally present products so that the consumer responds positively and purchases the products. Such displays require maximizing the product appeal and minimizing unsightly, undesirable clutter of the aisles and shelves. The more presentable and appealing the displays, the more consumers will be inclined to purchase products, as the consumers can more easily visualize the product similarly presented in their home. Obviously, the retailers desire optimum presentation, but prefer flexible setups that enable floor plan adjustment and variation in product selection as consumer interest and demand varies.

In particular, one type of consumer warehouse is commonly referred to as a home center. As the name implies, home centers target the do-it-yourself consumer and provide products of all sorts related to home improvement. While the list of possible projects supported by products found at home centers is too numerous to mention, by way of example, consumers can choose from remodeling a basement to refinishing a roof and anything inbetween, inside and outside of the home. With respect to home centers, home designers desire to present products as they would normally appear in the home, enabling consumers to visualize that product inside their own home.

More specifically, consumers generally exhibit considerable interest in ceiling fixtures such as light fixtures, chandeliers, ceiling fans, and the like. The choices presented when choosing not only the what type of ceiling fixture, but what particular style as well are legion, and store designers attempt to facilitate the process by presenting the many possibilities in a simulated home-setting, by mounting such fixtures on overhead displays.

However, overhead displays present a number of challenges to the store layout designer. First, because home centers generally occupy warehouse-sized buildings having ceilings which may be as high as three stories, ceiling fixture displays often, if not always, require a false ceiling to simulate more common ceiling heights of, for example, twelve feet or less. Such heights move the product significantly closer to the consumer so that display dimensions better approximate installed dimensions, making the display more realistic to the consumer. Second, ceiling fixture displays preferably lend themselves to flexibility in sizing and location within the store so that displays may be easily modified to accommodate greater or fewer products as consumer demand and display availability dictate. Third, many store designers desire the appearance of a no-frills, do-it-yourself atmosphere, leading the consumer to believe that the store has minimal overhead and that they are receiving the best deal possible.

One significant drawback of available ceiling fixture displays is that once they are located in the store, they are difficult to modify or resize. That is, designers design the ceiling fixture display directly into home center. The built-in ceiling fixture displays remain substantially permanent and typically offer little flexibility in sizing or locating the display. Thus, when designers desire to remodel the floor-plan layout to accommodate various consumer demands or product emphasis, the ceiling fixture displays often remain in place because they are difficult to relocate. Alternatively, modifying of the display requires significant building remodeling expenses and loss of valuable display and storage space for an extended period.

It is a first object of the present invention to provide a moveable, overhead display structure for the display of ceiling fixtures and the like which may be modified easily and inexpensively.

It is a second object of the present invention to provide an overhead display structure that is easily constructed, disassembled, relocated, and reconstructed in a time-efficient and cost-effective manner.

It is a third object of the present invention to provide an elevated, overhead display structure for the display of electrical ceiling fixtures and the like, such as lighting fixtures, chandeliers and ceiling fans.

SUMMARY OF THE INVENTION

Accordingly, the present invention is directed to an overhead display apparatus comprising a plurality of adjacent pairs of opposing support frames. Each support frame of the pairs of opposing support frames has a truss support extending vertically therefrom. A plurality of substantially horizontal trusses attach to the support frame. Each of the trusses has a first end and a second end, the first end being coupled to the truss support of one support frame of one of the pairs of opposing support frames and the second end being coupled to the truss support of the other support frame of the pair of opposing support frames. The plurality of trusses are thus adjacent in accordance with the plurality of adjacent pairs of opposing support frames. A plurality of purlins extend between adjacent trusses and attached thereto, and a plurality of fixture mounting bars extend across the purlins and attached thereto. Accordingly, the fixture mounting bars provide a mounting location for attaching at least one ceiling fixture.

Various other features and advantages will become apparent to one skilled in the art after having the benefit of studying the teachings of the specification, the drawings, and the claims.

BRIEF DESCRIPTION OF THE DRAWINGS

The various features and advantages of the present invention will become apparent to one skilled in the art upon reading the following specification, in which.

DESCRIPTION OF THE PREFERRED EMBODIMENT

Figure 1:
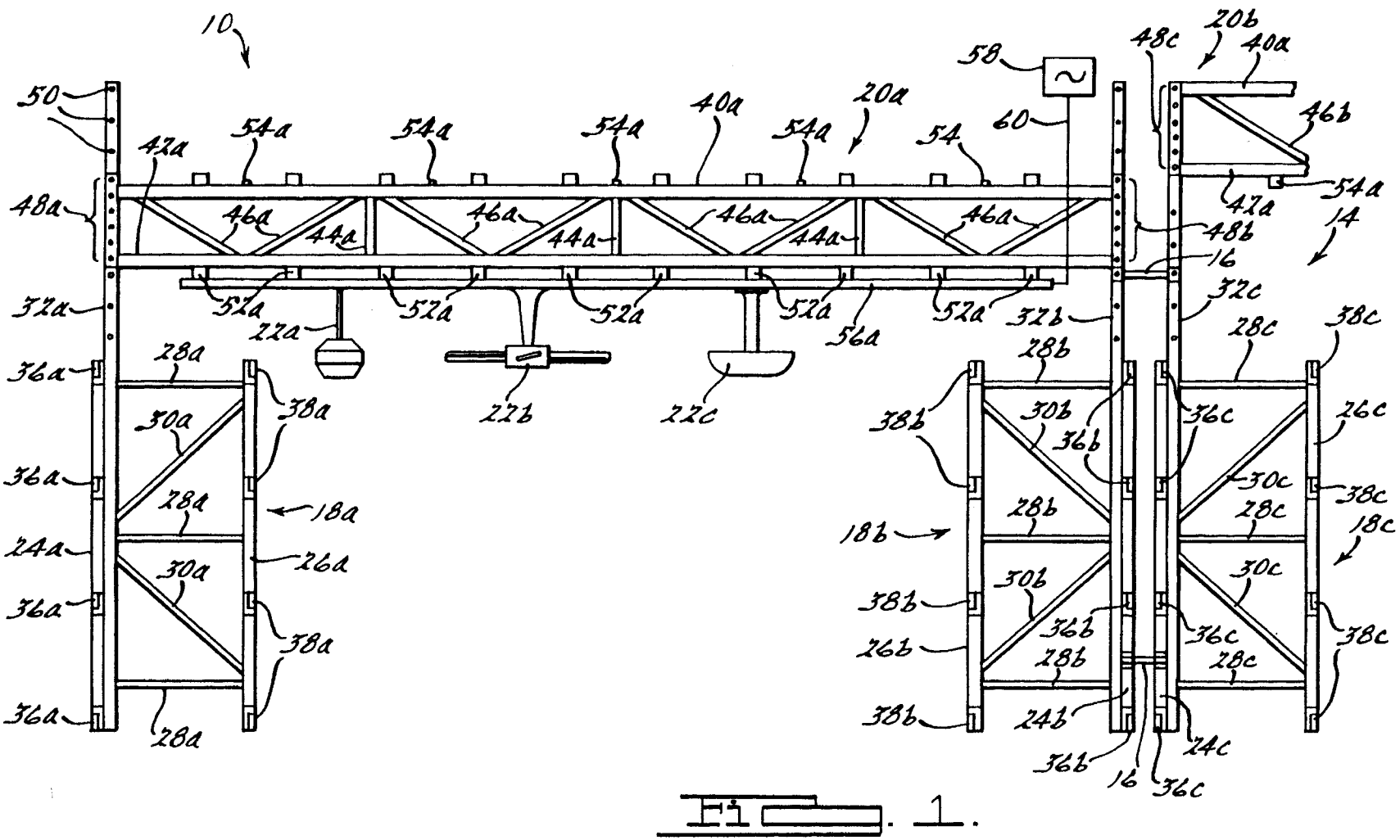
FIG. 1 is a partial front elevational view of a ceiling fixture display apparatus constructed according to the principles of a preferred embodiment of the present invention.

It should be understood from the outset that while the drawings and following discussion relate to a particular embodiment of the present invention, this embodiment merely represents what is presently regarded as the best mode of practicing the invention and other modifications may be made to the particular embodiment without departing from the spirit and scope of the invention. Note that throughout the specification like reference numerals and numerals having a letter appended thereto will reference similar elements performing similar functions throughout FIGS. 1 and 2.

Figure 2:
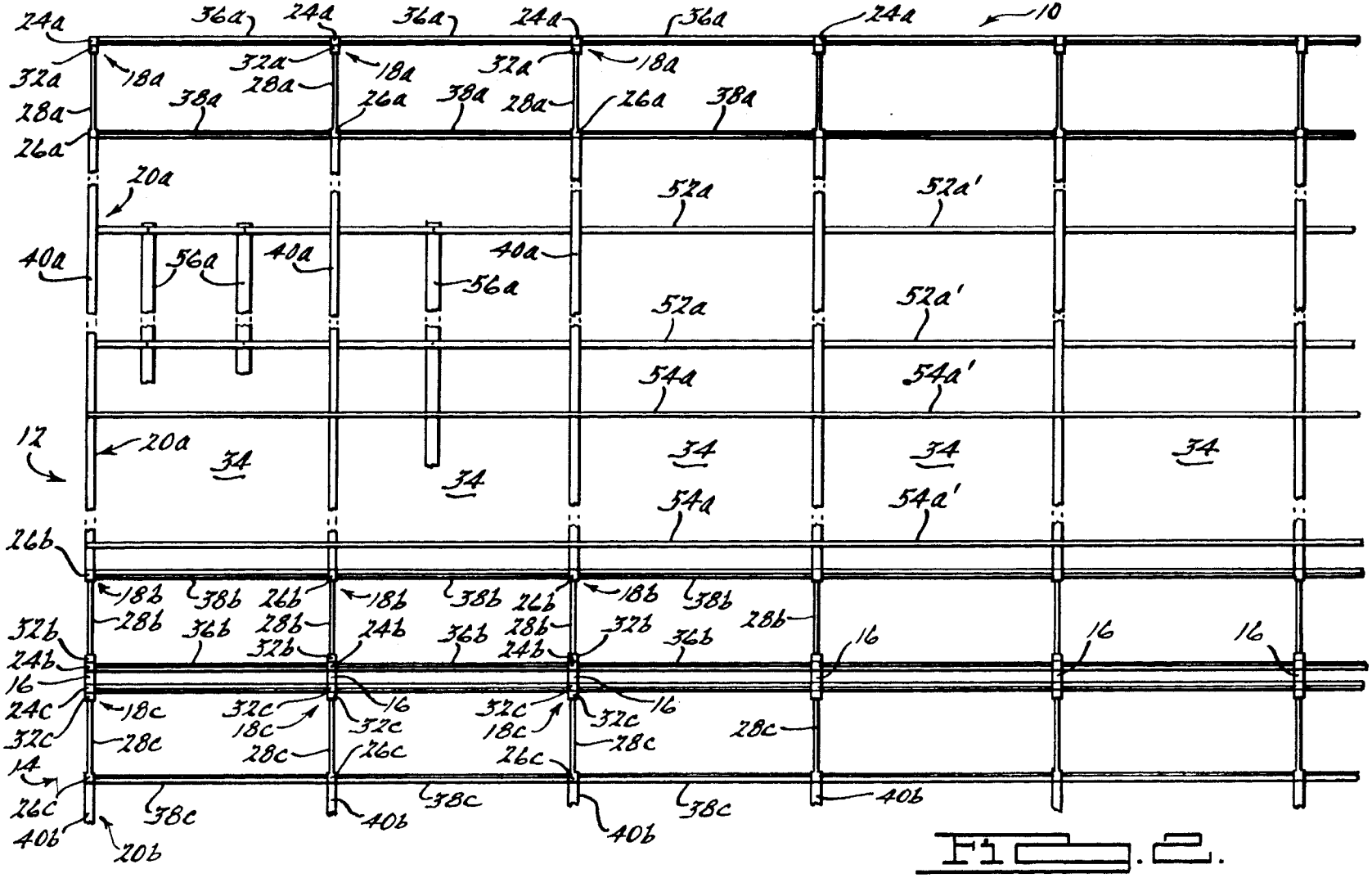
FIG. 2 is a partial plan view of the ceiling fixture display apparatus depicted in FIG. 1.

Referring to FIGS. 1 and 2, a partial front view of a preferred embodiment of the ceiling fixture display apparatus 10 is shown. FIGS. 1 and 2 depict the ceiling fixture display apparatus 10 having a first section 12 and a second section 14 (only partially shown). First section 12 and second section 14 are generally identical elements regarding their structural components, but may vary in dimension in accordance with design considerations dictated by available space and number of items to display. Row spacers 16 join first section 12 and second section 14.

First section 12 and second section 14 generally include a number of common structural components. These elements include frame assemblies 18*a*, 18*b*, and 18*c* and trusses 20*a* and 20*b*. Frames 18*a* and 18*b* support truss 20*a*, and frame 18*c* supports a portion of truss 20*b* (with another portion of truss 20*b* supported by a frame which is not shown). Trusses 20*a* and 20*b* provide convenient mounting locations for ceiling fixtures 22*a*, 22*b*, and 22*c*. Merely by way of example, ceiling fixture 22*a* depicts a hanging lamp; ceiling fixture 22*b* depicts a ceiling fan; and ceiling fixture 22*c* depicts a chandelier. Note that while ceiling fixtures 22*a–c* comprise primarily electrical fixtures, ceiling fixture display apparatus 10 optionally supports any of a variety of ceiling fixtures dictated by the particular application. Attachment of ceiling fixtures 22*a–c* to truss 20*a* (or 20*b*) is described later herein.

Describing frame assemblies 18*a–c* further, and referring to frame assembly 18*a* in particular, frame assembly 18*a* includes an outer upright frame 24*a* and an inner upright frame 26*a* linked by horizontal bracing members 28*a* and diagonal bracing members 30*a*. The horizontal and diagonal bracing members 28*a* and respectively, couple outer upright frame 24*a* and inner upright frame 26*a*. The upright frames and bracing members attach using weld connections as is known in the art. The assembly of outer upright frame 24*a* inner upright frame 26*a* to horizontal and diagonal bracing members 28*a* and 30*a*, respectively, assembles into what is typically known in the art as pallet racking. A vertical truss post 32*a* attaches to pallet racking assembly 18*a*, and in particular is welded to outer upright frame 24*a* to complete the frame assembly 18*a*. Truss post 32*a* is preferably a 3"×3" open rolled channel, but may be any of a number of sizes or materials in accordance with the particular application and applied load. Frame assemblies 18*b* and 18*c* similarly comprise the same elements and attachments as described with respect to frame assembly 18*a*.

As can be best seen in the plan view of FIG. 2, frame assemblies 18*a–*18*c* comprise a number of identical assemblies replicated and linked in order to provide a series of overhead display isles 34 under which customers walk in order to view overhead fixtures, such as ceiling fixtures 22*–c*. The series of frame assemblies 18*a–c* also provides framing for suitably supporting ceiling fixtures 22*a–c* and the like. Referring to FIGS. 1 and 2, a number of each of frame assemblies 18*a–c* are shown repeated and aligned. Outer step beam 36*a* and inner step beam 38*a* link frame assemblies 18*a*. In particular, outer step beam 36*a* and inner step beam 38*a* link two outer upright frame members 24*a* and two inner upright frame members 26*a*, respectively, as shown in FIGS. 1 and 2. Outer step beams 36*a* and inner step beams 38*a* attach to outer upright frames 24 and inner upright frames 26, respectively, and have a return flange (not shown) at each end inserted into a receiving keyhole of outer upright frames 24*a* and inner upright frames 26*a*, respectively. The step beams may optionally be through bolted to the receiving frame members for added stability of the assembly. As can be seen in FIG. 2, outer upright frames 24*a* and inner upright frames 26*a* may receive on either side outer step beams 36*a* and inner step beams 38*a*, respectively. The step beams 36*a* and 38*a* provide stability and enable frame assemblies 18 to stand upright and also enable assembly of a series of linked frame assemblies 18. Similarly, frame assemblies 18*b* and 18*c* are linked using step beams 36*b* and 38*b* and step beams 36*c* and 38*c*, respectively.

Referring to FIG. 1, truss post 32*a* extends vertically above upright frame members 24*a* and 26*a* and provides an attachment point for truss 20*a*. For example, truss posts 32*a* and 32*b* support truss 20*a* at each of its ends. Truss 20*a* comprises upper chord 40*a* and lower chord 42*a*, and vertical links 44*a* and diagonal links 46*a* couple upper chord 40*a* and lower chord 42*a*. Truss 20*a* is assembled by welding vertical links 44*a* and diagonal links 46*a* to upper chord 40*a* and lower chord 42*a* to form a substantially rigid structure. Further, truss 20*a* attaches to each of truss posts 32*a* and 32*b* at attachment points 48*a* and 48*b*, respectively, using through bolts or any other attachment means, many of which are well-known to one skilled in the art. Note that the height of truss 20*a* and truss 20*b* varies, as can be seen in FIG. 1, in accordance with the position of the attachment points 48*a* and 48*b* on their respective truss posts 32*a* and 32*b*. The height of truss 20*a* can be varied by selecting attachment points higher or lower on truss posts 32*a* and 32*b*. For this purpose, truss posts 32*a* and 32*b* include a number of through bolt holes 50 so that the height of truss 20*a* may be varied accordingly. Note that truss 20*a* extends between truss posts 32, as shown in FIG. 1, but such structure is not shown in FIG. 2 so that the top views of frame assemblies 18*a–c* may be shown.

In order to provide lateral stability of truss 20*a*, a number of lateral supports 54*a* couple upper cords 40*a* of truss 20*a*, providing stability and preventing the truss assemblies 20*a* from rolling under loads. As can be seen from FIG. 2, and merely by way of example, lateral supports 54*a* span four trusses 20*a*. In order to provide lateral support for structures greater than four trusses deep, an additional lateral support 54a' may be attached to the additional trusses to provide lateral support thereto. Lateral supports 54a are, for example, 1¼"×1½"×⅜" 16 gauge C-channel tubing and are attached to upper cords 40a using screws or through bolts. It should be noted that lateral braces 54a need not be of uniform length, and may vary in accordance with the particular design specification. However, in order to function as a lateral brace, a lateral brace must span and attach to at least two upper cords 40a of truss 20a.

Also spanning at least two trusses are purlins 52a which are typically 3"×3"×¾" 14 gauge C-channel. Purlins 52a attach to lower cords 42a using through bolts or any other appropriate securement means as is known in the art and function as a convenient anchor for light bar 56a. A light bar 56a attaches to purlins 52a also using through bolts or any other suitable attachment means. Light bar 56a provides a suitable mounting location for ceiling fixtures 22a–c and also optionally provide electrical power. In such displays, electrical power is typically supplied from overhead by a supply 58 using conductors 60 which traverse the length of light bar 56a. Light bar 56a may also optionally include the appropriate connectors (not shown) so that ceiling fixtures 22a–c requiring electrical power have a convenient source thereof. The position of light bar 56a and the number of light bars 56a provided across purlins 52a depends on the particular design requirements and the load bearing limitations of the frame assemblies 18a–c and trusses 20a–b. Of course, use of materials having increased load bearing properties and additional bracing further increases the load bearing capabilities of the ceiling fixture display apparatus 10.

Furthermore, as can be seen from FIG. 2, the ceiling fixture display apparatus 10 provides great flexibility in designing overhead displays, as the number of aisles 34 and the length of the aisles varies in accordance with the number and length of the trusses 20a and 20b (etc.) assembled in the system. The ceiling fixture display apparatus 10 is also highly modular and provides significant flexibility in expanding or reducing the size of the display as necessary.

The ceiling fixture display apparatus 10 also lends itself to ease of assembly in accordance with the following steps. First, frame assemblies 18a–c are linked using step beams 36a–c and 38a–c to provide the two supporting structures to which truss assembly 20a attaches frame assemblies 18a–c are preferably assembled a predetermined distance apart in accordance with the length of truss assemblies 20a–c. The frame assemblies 18a–c are thus erected as specified aisle dimensions. Next, a lift, such as a fork truck (not shown), raises the trusses so that they clear the upper-most portions of truss posts 32a–c and translates between the erected frame assemblies 18a–b (for example) to the particular truss post 32 to which the truss 20 is to be fastened. The truss 20 is then lowered to the predetermined height and assembled to the particular truss post 32. The fork truck then translates in an opposite direction out of the aisle so that another truss 20 may be lifted and moved into position for assembly to another pair of erected truss posts 32. Next, the purlins 52 are assembled at predetermined locations to bottom chord 42 of truss 20. Lateral supports 54 are then assembled to the top chords 40 of truss 20. Row spacers 16 are then assembled to link adjacent frame assemblies 18. Finally, if so desired, the erected frame assemblies 18 may be anchored to provide even greater stability to the ceiling fixture display apparatus 10.

From the foregoing discussion, one can see that this invention may be assembled and disassembled easily and inexpensively. This provides the end user with an overhead display structure that may be easily constructed, disassembled, relocated, and reconstructed. The flexibility provided by this invention is particularly attractive to large warehouse-sized stores which desire to provide displays of a variety of ceiling fixtures. Because the display may be relatively easily rearranged, the warehouse-sized stores receive greater flexibility in redesigning ceiling fixture displays as necessary. Further, this invention also provides electrical power from overhead so that electrical ceiling fixtures and the like may be activated to better simulate actual use.

The present invention has been described in an illustrative manner. It should be understood that the terminology which has been used is intended to be in the nature of words of description rather than of limitation. Many modifications or variations to the present invention are possible in light of the above teachings. Therefore, within the scope of the following claims, the present invention may be practiced otherwise than as specifically described.

What is claimed is:

1. An overhead display apparatus comprising:

a plurality of adjacent pairs of opposing support frames, each support frame of said pairs of opposing support frames having a truss support extending vertically therefrom, each said truss support having a plurality of attachment points thereon;

a plurality of substantially horizontal, vertically adjustable trusses, each of said trusses having a first end and a second end, said first end being coupled to said truss support at one of said plurality of attachment points of one support frame of one of said pairs of opposing support frames and said second end being coupled to said truss support at one of said plurality of attachment points of the other support frame of said pair of opposing support frames, said plurality of trusses thereby being adjacent in accordance with said plurality of adjacent pairs of opposing support frames;

a plurality of purlins extending between adjacent trusses and attached thereto; and a plurality of fixture mounting bars extending across said purlins and attached thereto, said fixture mounting bars providing a mounting location for attaching at least one ceiling fixture.

2. The apparatus as defined in claim 1 further comprising a plurality of step beams coupling said adjacent support frames and providing lateral stability to said adjacent support frames.

3. The apparatus as defined in claim 2 wherein a first overhead display apparatus is juxtaposed with a second overhead display apparatus such that a support frame of said first overhead display apparatus is disposed in proximity to said second display apparatus, and a row spacer couples said support frames of said first and second overhead display apparatus.

4. The apparatus as defined in claim 1 wherein said plurality of purlins are substantially parallel and are aligned substantially perpendicular to said plurality of trusses.

5. The apparatus as defined in claim 1 wherein said plurality of fixture mounting bars are substantially parallel and are aligned substantially perpendicular to said plurality of purlins.

6. The apparatus as defined in claim 1 further comprising a plurality of lateral supports coupling said adjacent trusses and providing lateral stability to said adjacent trusses.

7. The apparatus as defined in claim 1 further comprising a source of electrical power, said source supplying electrical energy to outlets of said fixture mounting bar, thereby enabling operation of ceiling fixtures requiring electrical energy.

8. An overhead display apparatus for electrical fixtures comprising:

a plurality of adjacent pairs of opposing support frames, each support frame of said pairs of opposing support frames having a truss support extending vertically therefrom, each said truss support having a plurality of attachment points thereon;

a plurality of substantially horizontal, vertically adjustable trusses, each of said trusses having a first end and a second end, said first end being coupled to said truss support at one of said plurality of attachment points of one support frame of one of said pairs of opposing support frames and said second end being coupled to said truss support at one of said plurality of attachment points of the other support frame of said pair of opposing support frames, said plurality of trusses thereby being adjacent in accordance with said plurality of adjacent pairs of opposing support frames;

a plurality of purlins extending between adjacent trusses and attached thereto; and a plurality of fixture mounting bars extending across said purlins and attached thereto, said mounting bars providing a mounting location for attaching at least one ceiling fixture and having electrical conductors for providing electrical energy to said ceiling fixtures.

9. The apparatus as defined in claim 8 further comprising a plurality of step beams coupling said adjacent support frames and providing lateral stability to said adjacent support frames.

10. The apparatus as defined in claim 9 wherein a first overhead display apparatus is juxtaposed with a second overhead display apparatus such that a support frame of said first overhead display apparatus is disposed in proximity to said second display apparatus, and a row spacer couples said support frames of said first and second overhead display apparatus.

11. The apparatus as defined in claim 8 wherein said plurality of purlins are substantially parallel and are aligned substantially perpendicular to said plurality of trusses.

12. The apparatus as defined in claim 8 wherein said plurality of fixture mounting bars are substantially parallel and are aligned substantially perpendicular to said plurality of purlins.

13. The apparatus as defined in claim 8 further comprising a plurality of lateral supports coupling said adjacent trusses and providing lateral stability to said adjacent trusses.

14. The apparatus as defined in claim 8 further comprising a source of electrical power, said source supplying electrical energy to the electrical conductors of said fixture mounting bar.

15. An overhead display apparatus for electrical fixtures comprising:

a plurality of adjacent pairs of opposing support frames, each support frame of said pairs of opposing support frames having a truss support extending vertically therefrom, each said truss support having a plurality of attachment points thereon;

a plurality of step beams coupling said adjacent support frames and providing lateral stability to said adjacent support frames;

a plurality of substantially horizontal, vertically adjustable trusses, each of said trusses having a first end and a second end, said first end being coupled to said truss support at one of said plurality of attachment points of one support frame of one of said pairs of opposing support frames and said second end being coupled to said truss support at one of said plurality of attachment points of the other support frame of said pair of opposing support frames, said plurality of trusses thereby being adjacent in accordance with said plurality of adjacent pairs of opposing support frames;

a plurality lateral supports coupling said adjacent trusses and providing lateral stability to said adjacent trusses;

a plurality of purlins extending between adjacent trusses and attached thereto, said purlins being substantially parallel and being aligned substantially perpendicular to said plurality of trusses; and a plurality of fixture mounting bars extending across said purlins and attached thereto, said mounting bars providing a mounting location for attaching at least one ceiling fixture and having electrical conductors for providing electrical energy to said ceiling fixtures, said plurality of fixture mounting bars being substantially parallel and being aligned substantially perpendicular to said plurality of purlins.

* * * * *